US005505888A

United States Patent [19]

Mitchell et al.

[11] Patent Number: 5,505,888

[45] Date of Patent: Apr. 9, 1996

[54] PROCESS FOR PREPARATION OF CELLULOSE ACETATE FIBERS USEFUL IN PREPARATION OF PAPER PRODUCTS

[75] Inventors: Melvin G. Mitchell; Lee R. Partin, both of Kingsport, Tenn.

[73] Assignee: Eastman Chemical Company, Kingsport, Tenn.

[21] Appl. No.: 245,117

[22] Filed: May 17, 1994

[51] Int. Cl.[6] ..... D02J 1/22; D06M 11/05

[52] U.S. Cl. ..... 264/138; 264/289.6; 264/290.5; 264/344

[58] Field of Search ..... 264/138, 142, 264/143, 200, 211.15, 289.6, 290.5, 340, 344

[56] References Cited

U.S. PATENT DOCUMENTS 3,396,061 8/1968 Browne ..... 156/178

3,781,949 1/1974 Breen et al. ..... 264/289.6 X

*Primary Examiner*—Leo B. Tentoni

*Attorney, Agent, or Firm*—Charles R. Martin

[57] ABSTRACT

A process to prepare cellulose acetate fibers useful for preparation of paper products. This process includes (A) tensioning a running band of cellulose acetate filter tow, (B) contacting the tensioned tow with water, (C) removing water from the tow, (D) drying the tow, (E) cutting the dried tow into lengths, and (F) packaging the cut tow.

5 Claims, No Drawings

PROCESS FOR PREPARATION OF CELLULOSE ACETATE FIBERS USEFUL IN PREPARATION OF PAPER PRODUCTS

FIELD OF THE INVENTION

This invention relates to a process for preparation of cellulose acetate fibers from filter tow which are useful for preparation of paper products.

BACKGROUND OF THE INVENTION

Cellulose acetate fibers are well known and are used in many commercial applications. For example, it is well known that a combination of a minor amount of cellulose acetate fibers and a major amount of natural cellulose can be used to prepare paper products.

We have now discovered a process wherein cellulose acetate filter tow can be prepared into a product which can be combined with natural cellulose to prepare paper products.

SUMMARY OF THE INVENTION

In summary, the process of this invention is comprised of (A) tensioning a running band of cellulose acetate filter tow, (B) contacting the tensioned tow with water, (C) removing water from the tow, (D) drying the tow, (E) cutting the dried tow into lengths, and (F) packaging the cut tow.

DESCRIPTION OF THE PREFERRED EMBODIMENTS

The practice of the process of this invention involves the use of cellulose acetate filter tow. By the term "cellulose acetate filter tow" we mean a tow composed of continuous filaments of cellulose acetate suitable for preparation into tobacco smoke filters for cigarettes. Any cellulose acetate filter tow useful in practicing this invention can be used. In a preferred embodiment, a cellulose acetate filter tow which does not meet the manufacturing specifications established by the manufacturer can be used. Typically, such filter tow contains about 0.5 weight percent titanium dioxide pigment, about 1 weight percent lubricant and about 6 weight percent water.

In accordance with this invention, the cellulose acetate filter tow is in the form of a band. The size of the individual fibers in the band can vary widely and can be in the range of 1 to 10 denier. The total size of the band can also vary widely and can be in the range of 10,000 to 80,000 denier. The use of a band having a larger total denier is preferred since fewer bales must be used to achieve a given quantity of product.

The tow can be tensioned using any conventional method of tensioning a continuous running band of tow. In one preferred embodiment, the tow is tensioned by the use of the upstream rolls operating at a slightly faster speed than the down stream rolls.

The speed of the continuous running band of tow can be any speed suitable for practicing the process of this invention. In a preferred embodiment the speed is in the range of 10 to 250 meters/min.

In the second step of the process the lubricant on the fibers is removed by washing the band of tow in a water bath.

The washing can be accomplished by a variety of methods well known in the art for washing a band of tow. For example, the band of tow can be conducted through a water trough using conventional rolls.

The time the tow band can be washed can vary widely depending on the particular washing method employed. In one embodiment the tow can be washed for one second.

In this invention the temperature of the water used to contact the tensioned tow is in the range of 20° to 90° C., preferably 30° to 50° C. The temperature is maintained in these ranges by use of a conventional heater.

The amount of lubricant removed in the washing step can vary widely but it is helpful in accomplishing the cutting step if a small amount of lubricant remains on the filter tow. Typically, the amount of lubricant which remains on the tow should be in the range of about 0.10 weight percent to about 0.4 weight percent.

In the third step water is removed from the tow to result in the amount of water being less than 60 weight percent, based on the weight of the tow and water.

The water can be removed from the tow using conventional means well known in the art. In one embodiment, a single or dual air dewatering jet can be used to blow the water off the tow. In a preferred embodiment, the tow can be conducted through a motor driven pinch roll which squeezes water from the tow band. The pressure on the pinch rolls can be set to meet the particular requirements of any specific process according to methods well known in the art. The use of pinch rolls is preferred because this approach requires less capital than the use of air jets.

Much of the original crimp in the filter tow is removed in the second and third steps. Although it is not necessary in the broadest embodiment of the invention, in a preferred embodiment of the invention additional crimp can be removed by drafting the tow in the range of 1 to 20 percent. The drafting can be accomplished using conventional methods, such as use of an upstream roll operating at a higher speed. In this embodiment, the speed of the second roll can be adjusted to advance the tow from 0 to 20 percent, preferably 4 percent, faster than the first roll.

In the fourth step the tow is dried to reduce the water content to less than 20 weight percent, and preferably less than about 10 weight percent, based on the weight of the tow and water. The drying step can be accomplished by conventional methods well known in the art. In one embodiment, the drying step is accomplished by use of pinch rolls which pull the tow band to the dryer, a tow spreader which distributes the tow band in a pattern as it enters a recirculating hot air dryer and an air jet to fluff the tow band. Optionally, the pressure on the pinch rolls can be adjusted to remove additional water from the tow. In one embodiment, an amount of water can be removed by adjusting the pressure on the pinch rolls to result in the amount of water remaining on the tow approaching 20 weight percent, based on the weight of the tow and water. Although operation of the dryer is conventional, important operating parameters are the residence time within the dryer, which is typically in the range of 30 seconds to 10 minutes, the air temperature, which is typically in the range of 65 C to 125 C, the air velocity as it contacts the tow, which is typically in the range of 0.5 to 3 ft/sec and fresh air being introduced to the recirculating hot air to keep the relative humidity of the air relatively low, typically below 50 percent.

In the fifth step of the process the dried filter tow is cut into lengths in the range of ⅛" to ¾", preferably about ¼", using conventional means In one embodiment, the tow can be cut with a high speed rotary or guillotine type cutter commonly used in the textile industry. In a preferred embodiment, a high speed rotary cutter is used.

In the sixth step of this process the cut fiber is packaged in a suitable container. For example, the cut fiber can be packaged in bags, boxes or bales. Preferable, the cut tow is packaged in the form of a bale using a broke type baler well known in the art.

The cut fibers prepared by the process of this invention can be used as an additive to for the preparation of paper products using conventional paper manufacturing equipment.

Example 1

The process of this invention was practiced in the following manner.

A band of a cellulose acetate filter tow was formed from four bales. The denier per filament was 3.2 and the total denier of the band was 128,000. Conventional guides and tensioning devices were used to tension the four tow bands and merge them into one tow band on a first set of pull rolls running at 31.5 meters/minute.

The tow band was immersed in a water bath controlled at 30° C. with a large excess of fresh water feed. A second set of rolls running at 35.0 meters/minute applied tension to the tow within the water bath.

A single air dewatering jet was employed to blow water off the tow band after it left the water bath.

A third set of rolls running at 35.5 meters/minute was used to remove substantially all remaining crimp from the tow band.

The tow band was pulled to the tow spreader at the dryer by an air jet and spread onto the apron of a hot air conveyor dryer operating at 75° C. The tow band had a residence time of 3 minutes on the apron.

A conventional cutter pulled the tow band from the dryer and cut the band into ¼" lengths.

The ¼" lengths were baled into 250 pounds bales.

The product was combined with natural cellulose and used to prepare paper products.

Example 2

The process of this invention was practiced in the following manner.

A band of a cellulose acetate filter tow was formed from six bales. The denier per filament was 3.2 and the total denier of the band was 192,000.

Conventional guides were used to tension the six tow bands and merge them into one tow band.

The tow band was immersed in a water bath controlled at 40° C. by use of a set of rolls running at 100 meters/minute. The water bath was initially filled with water and 1 weight percent lubricant. Fresh water was added during the process.

Pinch rolls were applied to squeeze water off the tow band as it left the water bath. The roll pressure was set at 56 psig air pressure to squeeze the water off the tow and bring the water concentration down to approximately 55 weight percent water. An air-driven motor on the rolls assisted in the movement of the tow band.

A set of rolls running at 103.4 meters/minute was used to remove substantially all remaining crimp from the tow band.

The tow band was pulled to the dryer by a second set of pinch rolls where sufficient additional water was squeezed from the tow band to result in the amount of water being approximately 20 weight percent water, based on the weight of the tow and water. A tow spreader and air jet fed the fluffed tow onto the apron of a hot air conveyor dryer. The dryer was operated at 115° C. The tow band had a residence time 2 minutes on the apron. The amount of water remaining on the tow was about 10 weight percent, based on the weight of the tow and water.

A conventional cutter pulled the tow band from the dryer and cut the band into ¼" lengths.

The ¼" lengths were baled into 250 pounds bales.

The product was combined with natural cellulose and used to prepare paper products.

We claim:

1. A process comprising (A) tensioning a running band of cellulose acetate filter tow, (B) contacting the tensioned tow with water at a temperature in the range of 20° to 90° C., (C) removing water from the tow to result in the amount of water being less than 60 weight percent, based on the weight of the tow and water, (D) drying the tow to reduce the water content to less than 20 weight percent, based on the weight of the tow and water, (E) cutting the dried tow into lengths in the range of ⅛" to ¾", and (F) packaging the cut tow.

2. The process of claim 1 wherein the temperature in step (B) is in the range of 30° to 50° C.

3. The process of claim 1 wherein the tow is dried in step (D) to reduce the water content to less than about 10 weight percent.

4. The process of claim 1 wherein the tow is cut into lengths of about ¼" in step (E).

5. A process comprising (A) tensioning a running band of cellulose acetate filter tow, (B) contacting the tensioned tow with water at a temperature in the range of 30° to 50° C., (C) removing water from the tow to result in the amount of water being less than 60 weight percent, based on the weight of the tow and water, (D) drafting the tow in the range of 1 to 20 percent, (E) drying the tow to reduce the water content to less than about 10 weight percent, based on the weight of the tow and water, (F) cutting the dried tow into lengths of about ¼, and (G) packaging the cut tow.

* * * * *